US009950510B2

(12) United States Patent
Zhang

(10) Patent No.: US 9,950,510 B2
(45) Date of Patent: Apr. 24, 2018

(54) LIQUID EJECTING APPARATUS

(71) Applicant: SEIKO EPSON CORPORATION, Tokyo (JP)

(72) Inventor: Junhua Zhang, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/247,197

(22) Filed: Aug. 25, 2016

(65) Prior Publication Data

US 2017/0057223 A1 Mar. 2, 2017

(30) Foreign Application Priority Data

Aug. 27, 2015 (JP) ..... 2015-167391

(51) Int. Cl.
*B41J 2/045* (2006.01)
*B41J 2/01* (2006.01)

(52) U.S. Cl.
CPC ..... *B41J 2/01* (2013.01); *B41J 2/04533* (2013.01); *B41J 2/04541* (2013.01); *B41J 2/04581* (2013.01); *B41J 2/04586* (2013.01)

(58) Field of Classification Search
CPC ..... B41J 2/01; B41J 2/04541; B41J 2/04586; B41J 2/04581; B41J 2/04533
See application file for complete search history.

(56) References Cited

U.S. PATENT DOCUMENTS

2006/0170717 A1* 8/2006 Kondoh ..... B41J 2/04555 347/5
2006/0197811 A1* 9/2006 Kuwahara ..... B41J 2/04526 347/82

FOREIGN PATENT DOCUMENTS

JP 07-081055 A 3/1995
JP 1997-011459 * 1/1997 ..... B41J 2/045
JP 1997-011459 A * 1/1997 ..... B41J 2/045

* cited by examiner

*Primary Examiner* — Yaovi M Ameh
(74) *Attorney, Agent, or Firm* — Foley & Lardner LLP

(57) ABSTRACT

A liquid ejecting apparatus includes a recording head including a plurality of nozzles from which liquid is ejected, a plurality of pressure chambers which communicate with each nozzle, respectively, a piezoelectric element which causes liquid to be ejected from the nozzle by causing a pressure fluctuation in the liquid in the pressure chamber, and a printer controller which is connected to the piezoelectric element through an individual signal line, and supplies a driving signal which drives the piezoelectric element through the individual signal line. The individual signal line is provided as many as n times (here, n is natural number of 2 or more) or more of the number of pressure chambers.

4 Claims, 6 Drawing Sheets

LIQUID EJECTING APPARATUS

BACKGROUND

1. Technical Field

The present invention relates to a liquid ejecting apparatus which causes liquid to be ejected from nozzles, when a piezoelectric element is driven by being applied with a driving signal.

2. Related Art

The liquid ejecting apparatus is an apparatus which can cause liquid to accurately land on a predetermined position in a target (landing target of liquid), by causing the liquid to be ejected from nozzles of a liquid ejecting head. The above described liquid ejecting head is configured so that a pressure fluctuation is caused in a space in which liquid is stored, by driving an actuator such as a piezoelectric element, and liquid is ejected from nozzles using the pressure fluctuation (for example, refer to JP-A-07-81055). As the liquid ejecting apparatus, for example, there is an image recording apparatus such as an ink jet printer, or an ink jet plotter, and recently, the liquid ejecting apparatus is also applied to various manufacturing apparatuses, by bringing out a merit that it is possible to make liquid of a minute amount accurately land on a predetermined position. For example, the apparatus is applied to a display manufacturing apparatus which manufactures a color filter of a liquid crystal display, or the like, an electrode forming apparatus which forms an electrode of an organic electro luminescence (EL) display, a surface light emitting display (FED), or the like, and a chip manufacturing apparatus which manufactures a biochip (biotip). In a recording head for an image recording apparatus, liquid ink is ejected, and a solution of each coloring material of R (Red), G (Green), and B (Blue) is ejected in a coloring material ejecting head for the display manufacturing apparatus. In addition, an electrode material of liquid is ejected in an electrode material ejecting head for the electrode forming apparatus, and a solution of a bio-organic material is ejected in a bio-organic material ejecting head for the chip manufacturing apparatus.

Meanwhile, since an amount of liquid which is ejected from a nozzle, a flying speed, or the like, is different depending on a use of a liquid ejecting apparatus (for example, use for recording image, or the like, on recording sheet, cloth, or the like, or use as various manufacturing apparatuses described above), a type of liquid to be ejected (water-base ink, photocurable ink, or various functional liquid of electrode material, or the like), viscosity, or the like, a nozzle, a flow path which communicates with the nozzle, and forming density or disposing density of an actuator are different between liquid ejecting apparatuses of which uses, or the like, are different. Similarly, a circuit for generating a driving signal which is applied to an actuator such as a piezoelectric element, or a signal path from the circuit to the actuator is also different depending on a use, or the like. In the related art, since an exclusive structure and components have been designed and manufactured, respectively, it caused cost rise.

SUMMARY

An advantage of some aspects of the invention is to commonize constituent components between liquid ejecting apparatuses of which uses, or the like, are different.

[Aspect 1]

According to an aspect of the invention, there is provided a liquid ejecting apparatus which includes a liquid ejecting head including a plurality of nozzles from which liquid is ejected, a plurality of pressure chambers which communicate with each nozzle, respectively, and an actuator which causes liquid to be ejected from the nozzle by causing a pressure fluctuation in the liquid in the pressure chamber; a driving circuit which is connected to the actuator through a driving signal line, and supplies a driving signal for driving the actuator through the driving signal line, in which the driving signal line is provided as many as n times (here, n is natural number of 2 or more) or more of the number of pressure chambers.

According to the configuration of Aspect 1, since the driving signal line is provided as many as n times or more of the number of pressure chambers, it is possible to commonize a configuration at least from the driving circuit to an end on an output side of the driving signal line between liquid ejecting apparatuses in which forming density/disposing density of a nozzle, a pressure chamber, or the like, is different.

[Aspect 2]

In the configuration of Aspect 1, it is preferable to adopt a configuration in which a plurality of actuators are provided as one set with respect to one pressure chamber, driving signal lines are respectively connected to each actuator, and the same driving signal is applied to each of actuator as one set.

According to the configuration of Aspect 2, since a plurality of actuators are provided in one pressure chamber as a set, it is possible to commonize a configuration at least from the driving circuit to the actuator between a liquid ejecting apparatus in which the pressure chamber and the driving signal line perform one-to-one correspondence and a liquid ejecting apparatus in which the number of pressure chambers and nozzles are smaller than those in the above described liquid ejecting apparatus. In addition, since each of actuators as one set which corresponds to one pressure chamber is driven at the same time by being applied with the same driving signal, it is possible to obtain a large driving force. In this manner, it is possible to eject liquid with high viscosity.

[Aspect 3]

In the configuration of Aspect 2, it is preferable to adopt a configuration in which a driving face which partitions one face of the pressure chamber includes an island portion to which the actuator is connected, and a flexible film with flexibility which surrounds the island portion, and the island portion has an integrated structure which is common to each of actuators as the one set.

According to the configuration of Aspect 3, since the island portion has the integrated structure which is common to each of actuators as one set, it is possible to further efficiently transmit a driving force of these actuators to liquid in the pressure chamber, and accordingly, ejecting efficiency is improved.

[Aspect 4]

In the configuration of Aspect 1, it is preferable to adopt a configuration in which one actuator is provided with respect to one pressure chamber, a plurality of the driving signal lines are connected to the one actuator, an end on an output side of each driving signal line is electrically connected, and the same driving signal is applied to the actuator, respectively, through each driving signal line.

According to the configuration of Aspect 4, it is possible to commonize a configuration at least from the driving circuit to an end on the output side of the driving signal line between the liquid ejecting apparatus in which the pressure chamber and the driving signal line perform one-to-one correspondence and the liquid ejecting apparatus in which the number of pressure chambers and nozzles is smaller than those in the above described liquid ejecting apparatus. In addition, it is possible to make the actuator large in the latter liquid ejecting apparatus. Due to this, rigidity of the actuator is further increased, and it is possible to obtain a large driving force. Due to this, it is possible to eject liquid with high viscosity.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
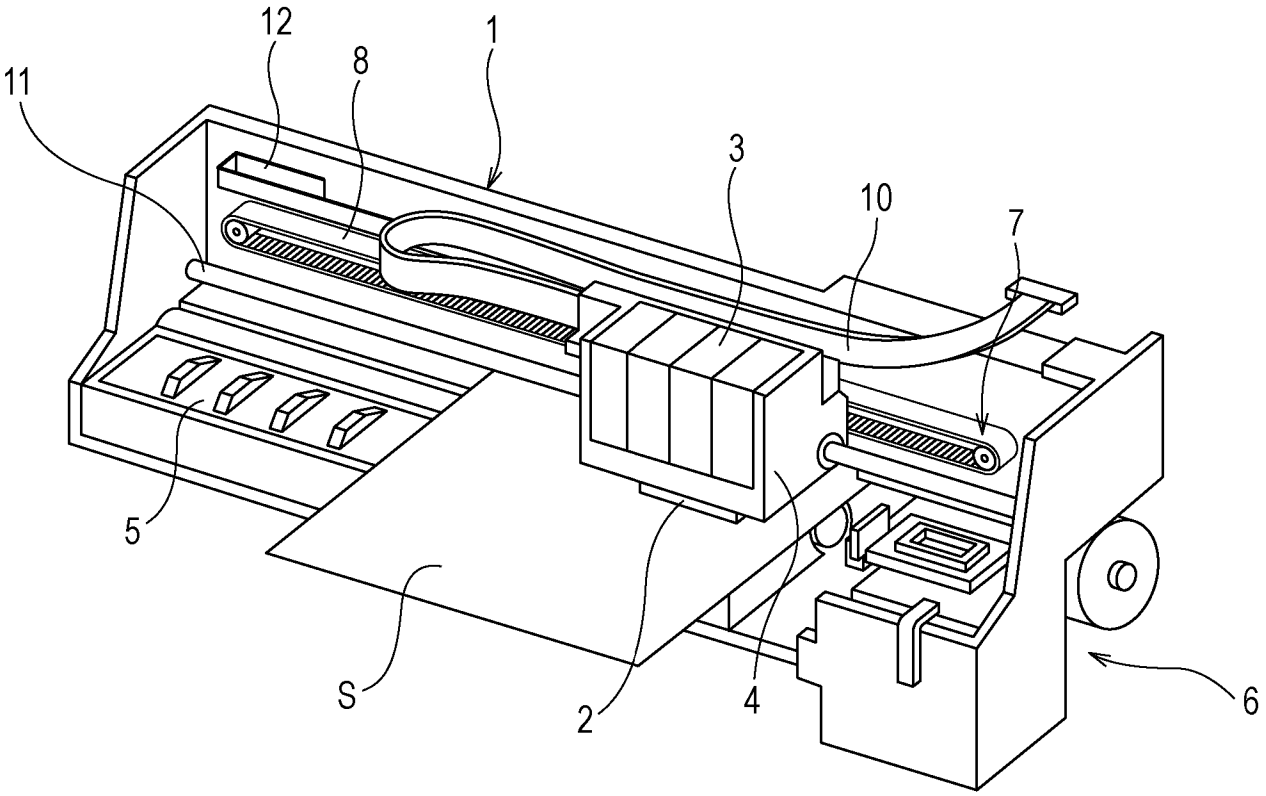
FIG. 1 is a perspective view which illustrates an internal configuration of a printer.

Hereinafter, embodiments for executing the invention will be described with reference to accompanying drawings. The embodiments which will be described below are variously limited as specific examples of the invention, which are preferable; however, the scope of the invention is not limited to these embodiments when there is no description for limiting the invention, particularly, in the following descriptions. Hereinafter, an ink jet printer (hereinafter, referred to as printer) as a type of a liquid ejecting apparatus on which an ink jet recording head (hereinafter, referred to as recording head) as a type of a liquid ejecting head is mounted will be described as an example.

A printer 1 is provided with a carriage 4 on which a recording head 2 which is a type of a liquid ejecting head is mounted, and to which an ink cartridge 3 (a type of liquid storage member) is detachably attached, a platen 5 which is provided below the recording head 2, a carriage moving mechanism 7 which moves the carriage 4 in a sheet width direction of a recording sheet S (a type of landing target), that is, a main scanning direction, a transport mechanism 6 which transports the recording sheet S in a sub-scanning direction which is a direction orthogonal to a head movement direction, a printer controller 9 (refer to FIG. 4) which controls each unit, and the like. A driving signal or various control signals from the printer controller 9 are transmitted to the recording head 2 through a flexible flat cable (FFC) 10. As the ink cartridge 3, a type which is mounted on the carriage 4, or a type in which ink is supplied to the recording head 2 through an ink supply tube by being mounted on a housing side of the printer 1 may be used.

The carriage 4 is attached in a state of being axially supported by a guide rod 11 which is built in the main scanning direction, and is configured so as to move in the main scanning direction along the guide rod 11 when the carriage moving mechanism 7 is operated. A position of the carriage 4 in the main scanning direction is detected by a linear encoder 12, and a detection signal is transmitted to a control unit 43 (refer to FIG. 4) of the printer controller 9 as a position information. In this manner, the control unit 43 can control a recording operation (ejecting operation), or the like, using the recording head 2, while recognizing a scanning position of the carriage 4 (recording head 2) based on the position information from the linear encoder 12.

Figure 2:
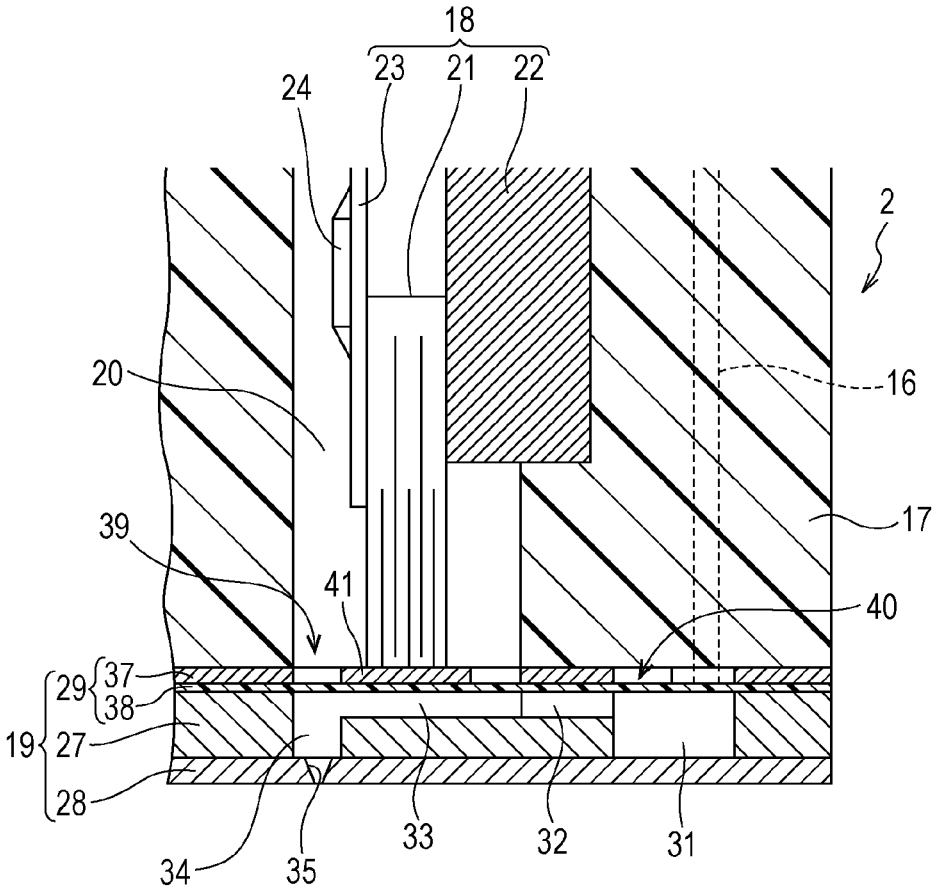
FIG. 2 is a sectional view of main portions which describes a configuration of a recording head.
Figure 3:
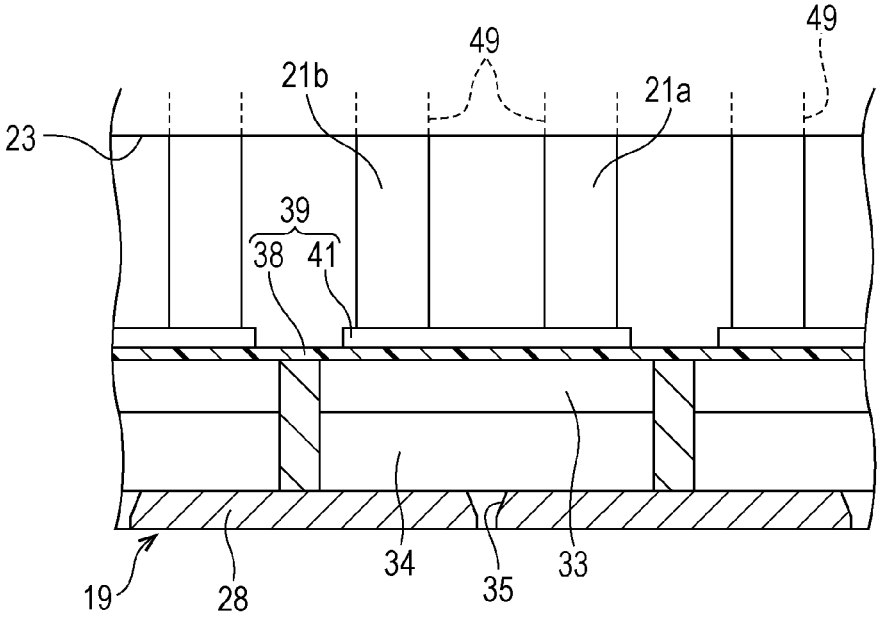
FIG. 3 is a sectional view of main portions of the recording head in a nozzle column direction.

FIG. 2 is a sectional view of main portions which describes a configuration of the above described recording head 2. FIG. 3 is a sectional view of main portions of the recording head 2 in a nozzle column direction, and illustrates a configuration in vicinity of a bonding portion to an island portion 41 (which will be described later) in a piezoelectric element 21 and a flow path unit 19. The recording head 2 is provided with a case 17, an actuator unit 18 which is accommodated in the case 17, the flow path unit 19 which is bonded to a bottom face (tip end face) of the case 17, and the like. The case 17 is manufactured, using an epoxy resin, for example, and in which an accommodating space 20 for accommodating the actuator unit 18 in the inside is formed. The actuator unit 18 is provided with the piezoelectric element 21 which functions as a type of the actuator, a fixing plate 22 to which the piezoelectric element 21 is bonded, and a wiring member 23 for supplying a driving signal, or the like, to the piezoelectric element 21.

The piezoelectric element 21 is a layered type which is manufactured by cutting and divide a piezoelectric plate in which a piezoelectric layer and an electrode layer are alternately layered in a comb tooth shape, and is a piezoelectric element of a longitudinal vibration mode which expands and contracts in a direction orthogonal to a layering direction. The wiring member 23 is configured of a film shaped member such as a tape carrier package (TCP), or the like. A driving IC 24 which performs a selective applying control of a driving signal with respect to the piezoelectric element 21 is mounted on the wiring member 23, in a region which faces the fixing plate 22. A tip end side of the wiring member 23 is electrically connected to an external electrode (individual electrode and common electrode) of the piezoelectric element 21. In addition, a rear end side of the wiring member 23 is electrically connected to a relay substrate (not illustrated) which relays a driving signal, or the like, from the FFC 10 side. In the actuator unit 18 according to the embodiment, each piezoelectric element 21 is aligned in forming density of two times of those in a nozzle 35 and a pressure chamber 33. Specifically, 180 piezoelectric elements 21 are formed in one inch, in contrast to 90 nozzles 35 and 90 pressure chambers 33 which are formed in one inch.

The flow path unit 19 has a configuration in which a nozzle plate 28 is bonded to one face of a flow path forming substrate 27, and a vibrating plate 29 is bonded to the other face of the flow path forming substrate 27, respectively. A common liquid chamber (reservoir) 31, an ink supply port 32, the pressure chamber 33, a nozzle communicating port 34, and the nozzle 35 are provided in the flow path unit 19. In the flow path forming substrate 27, an empty portion such as the pressure chamber 33 is formed by performing an anisotropic etching process with respect to a silicon wafer, for example. The above described pressure chamber 33 is formed as a chamber which is thin and long in a direction orthogonal to a column direction (nozzle column direction) of the nozzle 35. In addition, the common liquid chamber 31 is a space to which ink stored in the ink cartridge 3 is introduced through a case flow path 16, or the like, which is formed by penetrating the case 17 in a height direction. One end of the pressure chamber 33 in the longitudinal direction communicates with the common liquid chamber 31 through the ink supply port 32 which is individually provided in each pressure chamber. In addition, the other end of the pressure chamber 33 in the longitudinal direction communicates with a nozzle communicating port 34 which penetrates the flow path forming substrate 27 in the thickness direction, and communicates with the nozzle 35 through the nozzle communicating port 34.

The above described nozzle plate 28 is a thin metal plate in which the plurality of nozzles 35 are open in a column shape at a pitch corresponding to dot forming density. According to the embodiment, the nozzle plate 28 is manufactured, using a stainless steel plate member or a silicon plate member, and in which a plurality of columns of the nozzle 35 (nozzle column) are provided. According to the embodiment, one nozzle column has a configuration in which 90 nozzles 35 (forming density corresponding to 90 dpi) are arranged in one inch, for example. For this reason, the nozzle communicating port 34, the pressure chamber 33, and the ink supply port 32 are formed by using forming density corresponding to 90 dpi, in the above described flow path forming substrate 27.

The above described vibrating plate 29 is formed in a double structure in which a flexible film 38 with flexibility is stacked on the surface of a support plate 37 with relatively high rigidity. According to the embodiment, the vibrating plate 29 is manufactured, using a composite plate member which is obtained by setting a stainless steel plate as a type of a metal plate to the support plate 37, and laminating a resin film on the surface of the support plate 37 as the flexible film 38. In the vibrating plate 29, a diaphragm portion 39 is provided at a position corresponding to an upper opening of the pressure chamber 33, as a driving face which changes a volume of the pressure chamber 33. In addition, a compliance unit 40 which seals a part of the common liquid chamber 31 is provided in the vibrating plate 29.

The above described diaphragm portion 39 is manufactured by partially eliminating the support plate 37 using etching, or the like. That is, the diaphragm portion 39 is configured when the support plate 37 at the periphery of an island portion is eliminated, using etching, in a state in which a portion to which a tip end face of the piezoelectric element 21 is connected is left as an island portion 41 which is independent from another portion of the support plate 37. For this reason, the periphery of the island portion 41 is surrounded with the flexible film 38. The island portion 41, and the flexible film 38 at the periphery thereof function as the diaphragm portion 39. According to the embodiment, as illustrated in FIG. 3, one island portion 41 is formed with respect to one pressure chamber 33, and two tip end faces in total of the piezoelectric element 21 are bonded to the island portion 41. In other words, the island portion 41 has an integrated structure which is common to piezoelectric elements 21*a* and 21*b* which are a set. For this reason, the piezoelectric elements 21*a* and 21*b* which are a set displaces the island portion 41 by cooperating at the same time, and being driven in an expanding and contracting manner. In addition, related to the island portion 41, it is also possible to adopt a configuration in which an independent island portion is connected to each of the piezoelectric elements 21*a* and 21*b*, respectively, without being limited to the configuration of having the integrated structure which is common to the piezoelectric elements 21*a* and 21*b*, as in the embodiment.

The above described compliance unit 40 is manufactured by eliminating the support plate 37 in a region facing an opening face of the common liquid chamber 31 using etching, or the like, similarly to the diaphragm portion 39, and functions as a damper which absorbs a pressure fluctuation of liquid which is stored in the common liquid chamber 31.

In the recording head 2, when a driving signal is applied to the piezoelectric element 21 from a driving signal generating circuit 44 of the printer controller 9, through a signal path which is formed of the FFC 10, a relay substrate, and the wiring member 23, the piezoelectric element 21 expands and contracts in the longitudinal direction of the element, and the island portion 41 is displaced in a direction approaching the nozzle plate 28 or a direction separated from the nozzle plate 28, along with expanding and contracting of the piezoelectric element. Due to this, a volume of the pressure chamber 33 is changed, and a pressure fluctuation occurs in ink in the pressure chamber 33. As described above, since the piezoelectric elements 21*a* and 21*b* as a set displace the common island portion 41 at the same time in one pressure chamber 33, it is possible to cause a large pressure fluctuation using ink in the pressure chamber 33, compared to a configuration in which a single piezoelectric element of the same size as the piezoelectric elements 21*a* and 21*b* is provided in one pressure chamber. For this reason, the above described printer 1 is suitable for ejecting of ink with viscosity of 8 mPa·s or more in a normal temperature (25° C.), a so-called viscosity in high viscosity region, like photocurable ink which is cured by being radiated with light such as uv light, for example. In particular, since two piezoelectric elements 21 as a set are connected to one common island portion 41 in the embodiment, it is possible to further effectively transmit a driving force of the piezoelectric element 21 to ink in the pressure chamber, and accordingly, ejecting efficiency improves.

Figure 4:
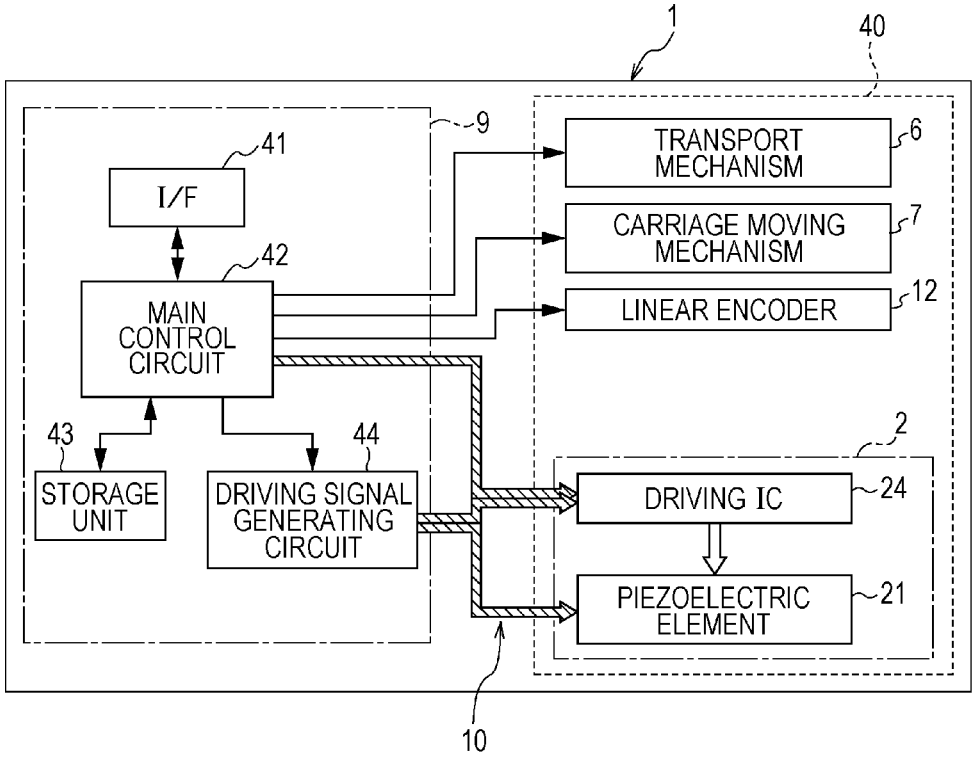
FIG. 4 is a block diagram which describes an electrical configuration of the printer.
Figure 5:
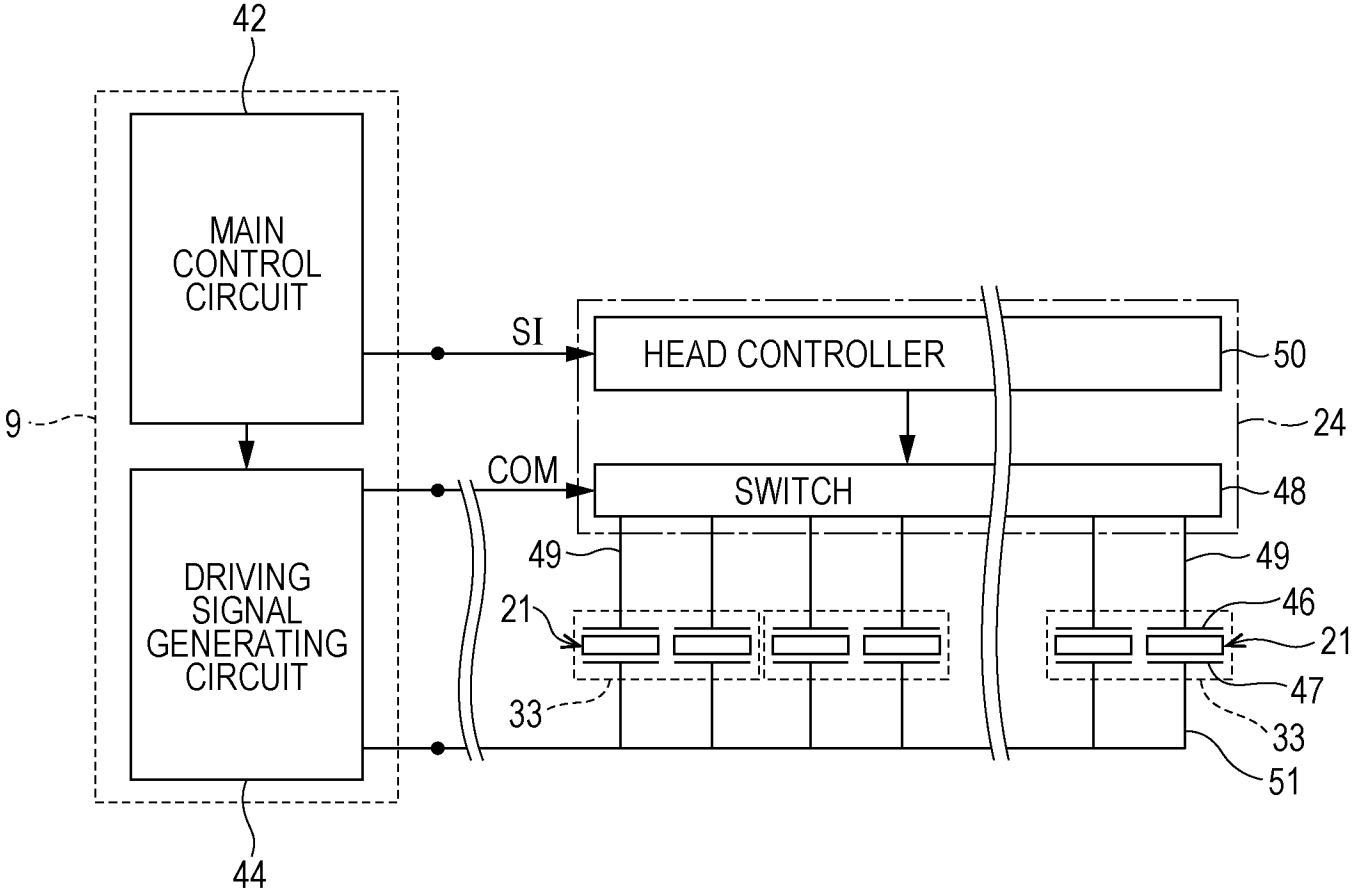
FIG. 5 is a schematic diagram which describes a signal path between a printer controller and a piezoelectric element.

FIG. 4 is a block diagram which illustrates an electrical configuration of the printer 1. FIG. 5 is a schematic diagram which describes a signal path between the printer controller 9 and the piezoelectric element 21. The printer 1 is schematically configured of the printer controller 9 (corresponding to driving circuit in the invention), and a print engine 40. The printer controller 9 is provided with an external interface (external I/F) 41 to which printing data, or the like, from an external device such as a host computer is input, a storage unit 43 which stores a control program for various controls, various data, and the like, a main control circuit 42 which performs a general control of each unit according to the control program which is stored in the storage unit 43, and the driving signal generating circuit 44 which generates a driving signal to be supplied to the recording head 2. Meanwhile, the print engine 40 is configured of the recording head 2, the carriage moving mechanism 7, the transport mechanism 6, and the linear encoder 12.

The main control circuit 42 develops printing data which is transmitted from an external device into ejecting data corresponding to a dot pattern, and transmits thereof to the recording head 2. In this case, the main control circuit 42 reads out printing data in a receiving buffer, converts the printing data into intermediate code data, and stores the intermediate code data in an intermediate buffer. In addition, the main control circuit 42 analyzes the intermediate code data which is read out from the intermediate buffer, and develops the intermediate code data into ejecting data (dot pattern data) for each dot, with reference to font data, graphic function, or the like, in the storage unit 43. The developed ejecting data is temporarily stored in an output buffer, and when ejecting data of one line corresponding to one main scanning is obtained, the ejecting data of one line is transmitted to the recording head 2 in series through the FFC 10. When the ejecting data of one line is transmitted from the output buffer, contents of the intermediate buffer is eliminated, and a conversion with respect to the subsequent intermediate code data is performed. In addition, in the recording head 2, a switch 48 is controlled based on the above described ejecting data, using a head controller 50 (refer to FIG. 5) of the driving IC 24 which is provided in the wiring member 23, and a driving signal is selectively applied to the piezoelectric element 21. In this manner, the piezoelectric element 21 is driven, and ejecting of ink droplets from the nozzle 35 is performed.

As illustrated in FIG. 5, the driving signal generating circuit 44, and an individual electrode 46 of the piezoelectric element 21 are electrically connected through the FFC 10, the wiring member 23, the driving IC 24 which is provided in the wiring member 23, and an individual signal line 49 (corresponding to driving signal line in the invention). In the embodiment, two piezoelectric elements 21 as a set, and two individual signal lines 49 correspond to one pressure chamber 33. That is, the individual signal line 49 which extends from the driving IC 24 is provided twice of the number of pressure chambers 33. In addition, the common electrode 47 of the piezoelectric element 21 is adjusted to a ground potential, or a constant bias potential through a common electrode line 51, the wiring member 23, and the FFC 10.

The above described driving IC 24 is provided with the head controller 50 and the switch 48. The head controller 50 outputs a switch control signal which controls the switch 48 which is provided corresponding to each piezoelectric element 21, respectively, based on ejecting data SI from the main control circuit 42. A driving signal COM from the driving signal generating circuit 44 side is input to the switch 48. The switch 48 switches an output state and a non-output state of the driving signal COM with respect to the individual electrode 46 of each piezoelectric element 21 based on a switch control signal from the head controller 50. As described above, in the printer 1 according to the embodiment, the piezoelectric element 21 is formed by using forming density corresponding to 180 dpi, in contrast to the above described flow path unit 19 in which the nozzle 35, the nozzle communicating port 34, the pressure chamber 33, and the ink supply port 32 are formed by using forming density corresponding to 90 dpi, in order to cause the elements to correspond to ejecting of ink with high viscosity. In addition, two piezoelectric elements 21 are formed as a set with respect to one pressure chamber 33. For this reason, in the embodiment, the switch 48 is controlled so that the same driving signal is applied to the piezoelectric elements 21 as a set, at the same time, definitely.

Figure 6:
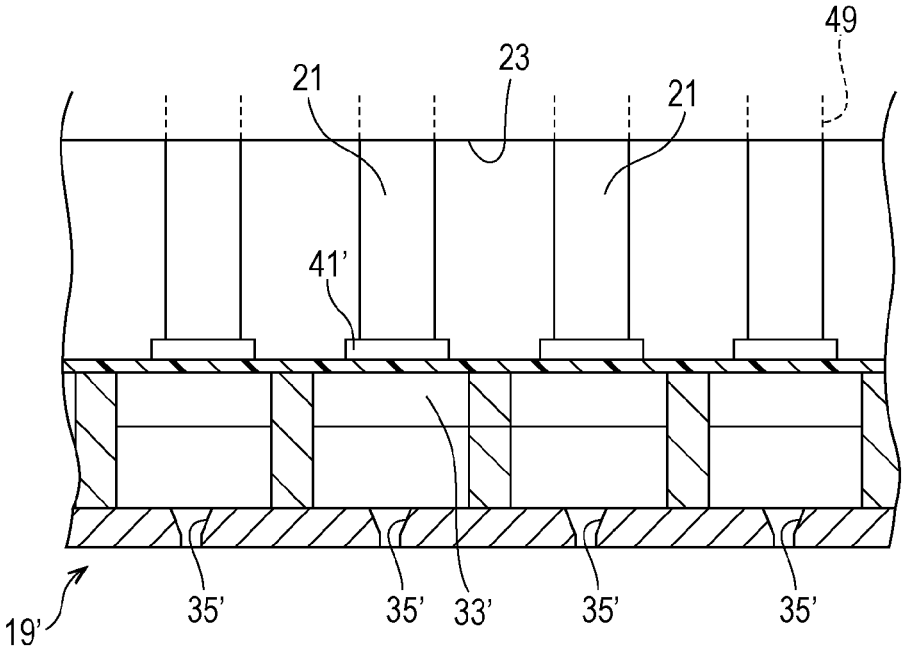
FIG. 6 is a sectional view of main portions of a recording head in a nozzle column direction, in a comparison example.

In this manner, since the plurality of individual signal lines 49 correspond to one pressure chamber 33, it is possible to commonize constituent components at least from the driving circuit (printer controller 9) to an end on the output side of the individual signal line 49, between liquid ejecting apparatuses in which a use, or a type of liquid to be ejected is different. That is, as illustrated in FIG. 6, for example, it is possible to commonize a configuration from the printer controller 9 to an end of the individual signal line 49 of the wiring member 23, between a printer 1 corresponding to recording in a relatively high resolution, in which a nozzle 35', or the like, is formed by using forming density of 180 dpi and a printer corresponding to ejecting of ink with relatively high viscosity, in which the nozzle 35, or the like, is formed by using forming density of 90 dpi, as in the embodiment. According to the embodiment, it is possible to commonize a configuration from the printer controller 9 to the piezoelectric element 21, since two piezoelectric elements 21 are provided with respect to one pressure chamber 33. That is, elements corresponding to a use, or the like, may be adopted only for the flow path unit 19. Here, a configuration illustrated in FIG. 6 is a configuration which is adopted in a printer which performs ejecting of water base ink which is general, and in which one piezoelectric element 21 and one individual signal line 49 correspond to one pressure chamber 33. Since it is possible to commonize constituent components between printers in which nozzle forming density is different in this manner, a production cost can be reduced. In addition, according to the embodiment, since each of the piezoelectric elements 21*a* and 21*b* corresponding to one pressure chamber 33 is driven at the same time by being applied with the same driving signal, it is possible to obtain a large driving force. In this manner, it is possible to eject ink with high viscosity.

Figure 7:
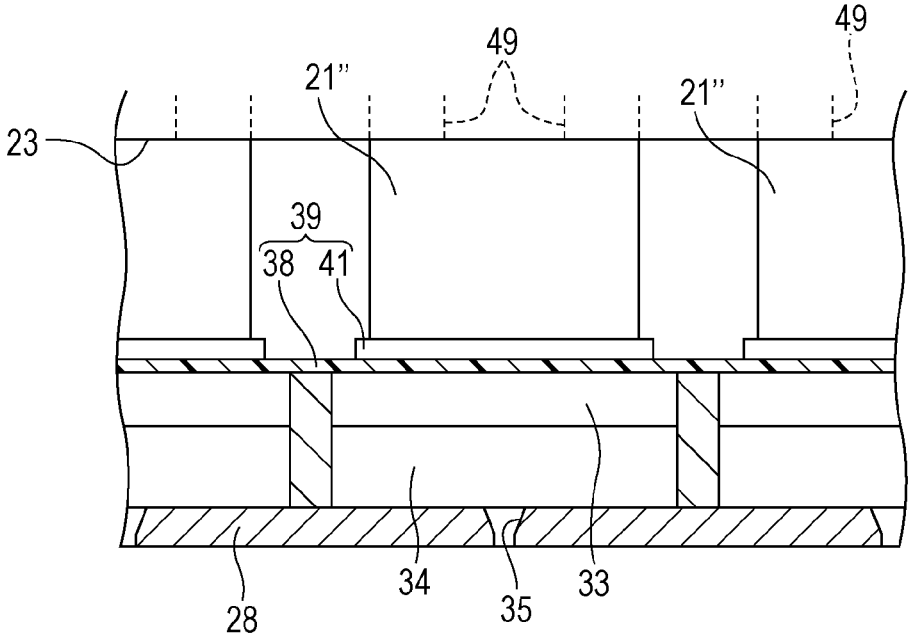
FIG. 7 is a sectional view of main portions of a recording head in a nozzle column direction, in a second embodiment.
Figure 8:
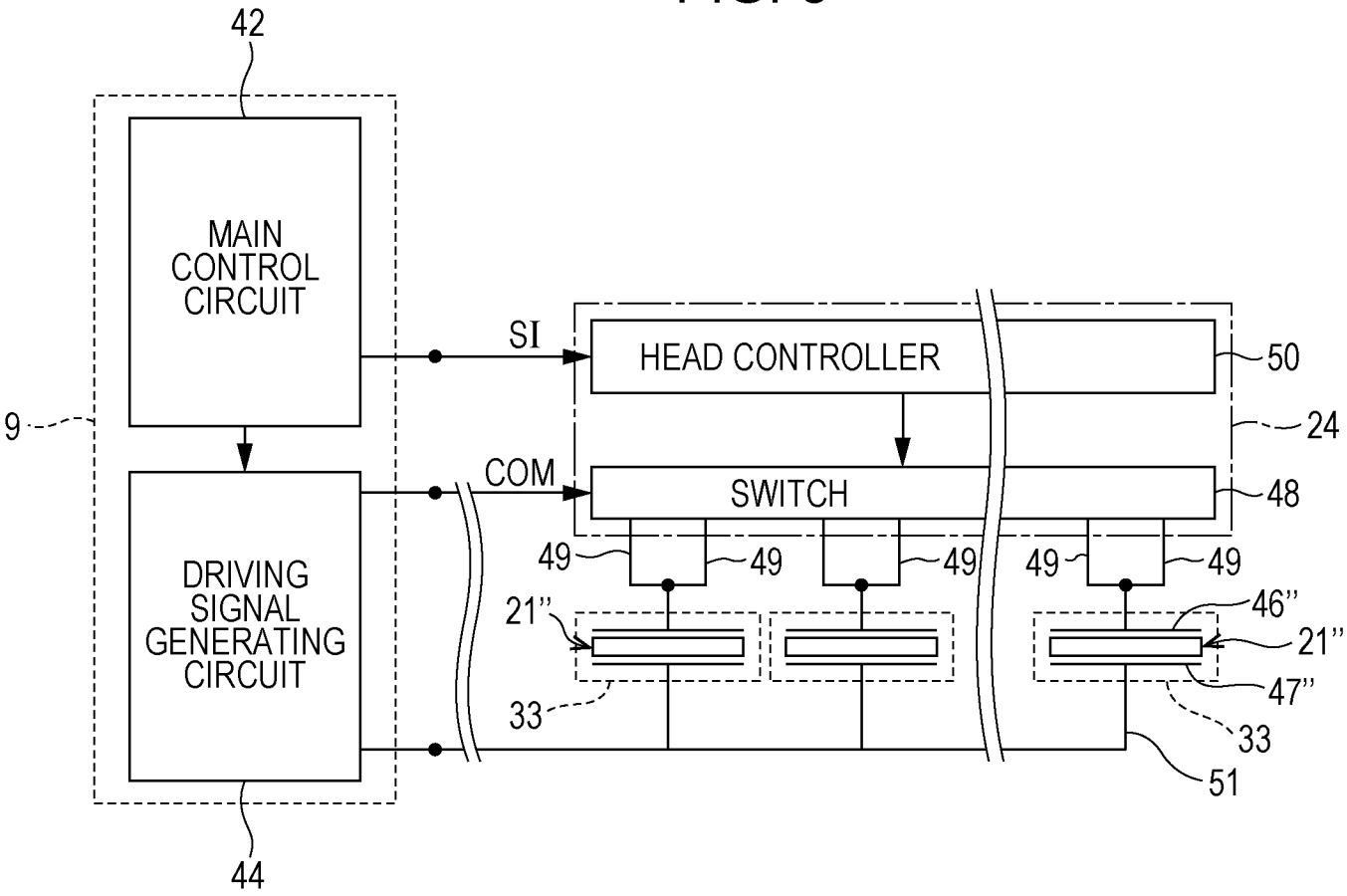
FIG. 8 is a schematic diagram which describes a signal path between a printer controller and a piezoelectric element in the second embodiment.

FIGS. 7 and 8 are diagrams which describe a second embodiment of the invention, in which FIG. 7 is a sectional view of main portions in a nozzle column direction of the recording head 2, and FIG. 8 is a schematic diagram which describes a signal path between the printer controller 9 and the piezoelectric element 21. In the above described first embodiment, the printer which has a configuration in which the nozzle 35, or the like, in the flow path unit 19 is formed by using forming density corresponding to 90 dpi, and meanwhile, forming density corresponding to 180 dpi is used between the printer controller 9 and the piezoelectric element 21 has been exemplified. In contrast to this, in the embodiment, the nozzle 35, or the like, in the flow path unit 19, and a piezoelectric element 21" are formed by using forming density corresponding to 90 dpi, and meanwhile, forming density corresponding to 180 dpi is used between the printer controller 9 and the end of the individual signal line 49 of the wiring member 23, and this point is different from the first embodiment. That is, one piezoelectric element 21" and two individual signal lines 49 correspond to one pressure chamber 33.

As illustrated in FIG. 8, two individual signal lines 49 corresponding to one piezoelectric element 21" are electrically connected to the same individual electrode 46" of the piezoelectric element 21". That is, it is a configuration in which ends on an output side of these individual signals line 49 are electrically connected to each other, and the same driving signal is applied to the individual electrode 46" of the piezoelectric element 21" through these individual signal lines 49. In this manner, it is possible to drive the piezoelectric element 21" without hindrance, even in a configuration in which two individual signal lines 49 are connected to one piezoelectric element 21". In addition, a configuration of the flow path unit 19 is the same as that in the first embodiment.

According to the embodiment, it is not possible to commonize the piezoelectric element 21" between liquid ejecting apparatuses in which forming density of a nozzle, or the like, is different (different in use, or the like); however, it is possible to commonize a configuration from the printer controller 9 to the end of the individual signal line 49 of the wiring member 23 between different liquid ejecting apparatuses, similarly to the above described first embodiment. In the piezoelectric element 21" in the second embodiment, one piezoelectric element 21" is provided with respect to one pressure chamber 33, and a width of the piezoelectric element 21" in a nozzle column direction is larger than that of the piezoelectric element 21 in the first embodiment. For this reason, in the embodiment, rigidity of the piezoelectric element 21" becomes high, and compliance becomes small compared to those in the first embodiment. Due to this, it becomes a configuration which is suitable for ejecting of ink with high viscosity. That is, in a case of ejecting ink with high viscosity, since transmission efficiency of a driving force of the piezoelectric element 21 with respect to the ink deteriorates when compliance of the piezoelectric element is large (rigidity of piezoelectric element is weak), it is necessary to drive the piezoelectric element using a high voltage. In contrast to this, in the embodiment, since rigidity of the piezoelectric element 21" increases, and compliance becomes small, it is possible to efficiently eject ink with high viscosity.

In each of the above described embodiments, the configuration in which the individual signal line 49 is provided twice of the number of pressure chambers 33 has been exemplified; however, it is not limited to this, and for example, three or more (three times or more) driving signal lines may be provided with respect to one pressure chamber 33. In this manner, it is possible to commonize constituent components such as a driving circuit between liquid ejecting apparatuses corresponding to a high resolution. In short, it is possible to adopt a configuration in which the individual signal line 49 is provided as many as n times (here, n is natural number of 2 or more) or more of the number of pressure chambers 33.

In the above described each embodiment, the configuration in which the piezoelectric element 21 of a so-called longitudinal vibration type which expands and contracts in a direction orthogonal to a layering direction (electric-field direction) has been exemplified; however, it is not limited to this, and for the piezoelectric element, it is possible to apply the invention also in a configuration in which a so-called bending vibration-type piezoelectric element which is deformed in a bending manner in the electric-field direction is adopted. Also in the configuration, it is possible to commonize the configuration from the driving circuit to the end of the individual signal line of the wiring member, between liquid ejecting apparatuses in which uses, or the like, are different, similarly to that in each of the above described embodiments, by having a configuration in which the individual signal line (driving signal line) which is connected to the individual electrode of the piezoelectric element is provided as many as n times or more of the number of pressure chambers.

As the actuator, it is not limited to the piezoelectric element, and for example, it is possible to apply the invention to a configuration in which another actuator such as a so-called electrostatic actuator in which a part of a pressure chamber is displaced by using an electrostatic force, or a heating element which causes a pressures fluctuation in a pressure chamber using bubbles which are generated in liquid due to heating is adopted.

Hitherto, a printer which is used in a use of recording an image, or the like, by ejecting ink onto a recording sheet, or the like, has been exemplified; however, it is not limited to this, and it is also possible to apply the invention to a printer which is used in a use of ejecting liquid other than ink. For example, it is also possible to apply the invention to another liquid ejecting apparatus which is provided with a coloring material ejecting head which is used in manufacturing of a color filter of a liquid crystal display, or the like, an electrode material ejecting head which is used in forming of electrodes of an organic electro luminescence (EL) display, a surface light emitting display (FED), or the like, a bio-organic material ejecting head which is used in manufacturing of a biochip (biotip), and the like.

The entire disclosure of Japanese Patent Application No. 2015-167391, filed Aug. 27, 2015 is expressly incorporated by reference herein in its entirety.

What is claimed is:

1. A liquid ejecting apparatus comprising:

a liquid ejecting head that includes:

a plurality of nozzles configured to eject liquid, the plurality of nozzles including a first nozzle and a second nozzle that are arranged side-by-side along a first direction, a plurality of pressure chambers, the plurality of pressure chambers including a first pressure chamber that communicates with the first nozzle and a second pressure chamber that communicates with the second nozzle, the first and second pressure chambers being arranged side-by-side along the first direction, a plurality of actuators configured to cause liquid to be ejected from the nozzles by causing a pressure fluctuation in the liquid in the pressure chambers when driving signals are applied to the actuators, the plurality of actuators including a first set of actuators configured to cause liquid to be ejected from the first nozzle by causing a pressure fluctuation in the liquid in the first pressure chamber, the actuators in the first set of actuators being arranged side-by-side along the first direction, each of the actuators comprising:

an individual electrode configured to have a respective driving signal applied thereto, and a common electrode configured to have a predetermined voltage applied thereto, and a common electrode line connected to the common electrodes of the actuators; and a driving circuit that is connected to the liquid ejecting head, the driving circuit being configured to supply the driving signals to be applied to the individual electrodes, and to supply the predetermined voltage to be applied to the common electrodes via the common electrode line, wherein the driving circuit is configured to send the same driving signal, always at the same time, to each of the individual electrodes of the actuators in the first set of actuators.

2. The liquid ejecting apparatus according to claim 1, wherein the driving circuit is connected to the actuators of the first set of actuators via a plurality of first driving signal lines, each first driving signal line being connected to a respective one of the actuators of the first set of actuators, and wherein the driving circuit is configured to send the same driving signal to each of the first driving signal lines that connect the driving circuit to the actuators of the first set of actuators.

3. The liquid ejecting apparatus according to claim 1, further comprising:

a switch provided on a signal path connected the driving circuit to the plurality of the actuators, the switch being configured to switch an output state and a non-output state of the driving signal with respect to the actuators, wherein the driving circuit is configured to control the switch so that the same driving signals are sent, always at the same time, to each of the individual electrodes of the actuators in the first set of actuators.

4. The liquid ejecting apparatus according to claim 2, wherein a driving face that partitions a face of the first pressure chamber includes an island portion to which the actuators of the first set of actuators are connected, and a flexible film that surrounds the island portion, and wherein the island portion has an integrated structure that is common to each of the actuators of the first set of actuators.

* * * * *